US006400348B1

(12) United States Patent
Young

(10) Patent No.: US 6,400,348 B1
(45) Date of Patent: Jun. 4, 2002

(54) ACTIVE MATRIX ELECTROLUMINESCENT DISPLAY DEVICE

(75) Inventor: Nigel D. Young, Redhill (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 194 days.

(21) Appl. No.: 09/584,814

(22) Filed: May 31, 2000

(30) Foreign Application Priority Data

Jun. 25, 1999 (GB) ..... 9914808

(51) Int. Cl.[7] ..... G09G 3/30

(52) U.S. Cl. ..... 345/78; 345/58; 345/76; 345/208; 315/169.3

(58) Field of Search ..... 345/76, 58, 78, 345/79, 204, 206, 208, 210, 211; 315/169.3, 291, 307

(56) References Cited

U.S. PATENT DOCUMENTS 4,633,141 A * 12/1986 Weber ..... 315/169.3
4,874,986 A * 10/1989 Menn et al. ..... 313/505
5,294,919 A * 3/1994 Harju ..... 315/169.3
5,517,207 A * 5/1996 Kawada et al. ..... 345/209
5,670,792 A 9/1997 Utsugi et al. ..... 257/59
5,828,354 A * 10/1998 Ebihara ..... 345/212
6,310,589 B1 * 10/2001 Nishigaki et al. ..... 345/76

FOREIGN PATENT DOCUMENTS

EP 0717446 A2 6/1996 ..... H01L/27/15

* cited by examiner

*Primary Examiner*—Kent Chang

(57) ABSTRACT

An active matrix electroluminescent display device comprises an array of display pixels 30 arranged in rows and columns with each row of pixels sharing a common line, and with currents through the display elements of a row of pixels passing along the common line. Error values (e) are generated to correct the drive signals (V) for each pixel in a row of pixels, to correct for the different voltages appearing on the common line. These different voltages give rise to horizontal cross talk. The error values (e) are derived by modelling a row of pixels, taking into account the drive signals applied to all pixels of the row. The error values result in updated drive signals (V').

6 Claims, 2 Drawing Sheets

ACTIVE MATRIX ELECTROLUMINESCENT DISPLAY DEVICE

BACKGROUND OF THE INVENTION

This invention relates to active matrix electroluminescent display devices, comprising an array of electroluminescent display pixels arranged in rows and columns. The invention is particularly concerned with display devices in which rows of pixels share a common line, with currents through the display elements of the row passing along the common line.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

The polymer material can be fabricated using a CVD process, or simply by a spin coating technique using a solution of a soluble conjugated polymer.

Organic electroluminescent materials exhibit diode-like I-V properties, so that they are capable of providing both a display function and a switching function, and can therefore be used in passive type displays.

However, the invention is concerned with active matrix display devices, with each pixel comprising a display element and a switching device for controlling the current through the display elements. Examples of an active matrix electroluminescent display are described in U.S. Pat. No. 5,670,792, the contents of which are incorporated herein by way of reference material.

A problem with display devices of this type arises from the fact that they have current driven display elements. Display devices of the type with which this invention is concerned include a common line on which the currents from all pixels in a row pass. Compounding currents from the pixels in a row give rise to different voltages along the common line. These voltages depend upon the currents through all pixels in the row, since these currents all pass to the common line. These different voltages give rise to undesired changes to the outputs from the display pixels, which vary as a function of the full set of signals applied to the row. Consequently, there is cross-talk between the pixels within the row.

SUMMARY OF THE INVENTION

According to the invention, there is provided an active matrix electroluminescent display device comprising:

an array of display pixels arranged in rows and columns, each pixel comprising an electroluminescent display element and a switching means for controlling the current through the display element based on a signal voltage applied to the pixel, each row of pixels sharing a common line, currents through the display elements of a row of pixels passing along the common line giving rise to different voltages along the common signal line; and driver circuitry for generating signal voltages corresponding to desired outputs from the display elements, and for applying signal voltages to rows of pixels in sequence, wherein the device further comprises:

means for generating error values for each pixel in a row of pixels to be addressed derived from modelling of a row of pixels, the modelling taking account of the signal voltages to be applied to the pixels in the row, and the error values being used to account for the different voltages on the common line;

means for updating the signal voltages for each pixel in the row of pixels to be addressed, where required, using the error values; and means for supplying the updated signal voltages to the pixels.

The modelling of a row of pixels enables a discrepancy between the desired output and the actual output to be corrected. This discrepancy arises from the different voltages on the common line at each pixel, which depends upon the signal voltages for the row of pixels. The device of the invention can thereby compensate for signal distortions resulting from cross-talk between pixels within a row.

The display element and the switching means are preferably arranged in series between a voltage supply line for the display elements and the common line, which acts as a current drain.

Each pixel may further comprise a charge storage element for holding a control voltage derived from the updated signal voltage on the switching means.

The invention also provides a method of driving an active matrix electroluminescent display device, comprising an array of electroluminescent display pixels arranged in rows and columns, each row of pixels sharing a common line, currents through the display elements of a row passing along the common line, different voltages thereby being present at different points along the common line, the method comprising addressing rows of pixels in sequence, and for each row of pixels generating voltage signals for the pixels in the row, the generated voltage signals corresponding to desired pixel outputs, wherein the method further comprises:

generating error values derived from modelling of a row of pixels to account for the different voltages on the common line, the modelling taking account of the signal voltages to be applied to the pixels in the row;

updating the signal voltages for each pixel in the row, where necessary, using the error values; and supplying the updated signal voltages to the pixels.

BRIEF DESCRIPTION OF THE DRAWING

The invention will now be described by way of example, with reference to and as shown in the accompanying drawings, in which.

The Figures are merely schematic and have not been drawn to scale. The same reference numbers are used throughout the figures to denote the same or similar parts.

DESCRIPTION OF THE PREFERRED EMBODIMENT

Figure 1:
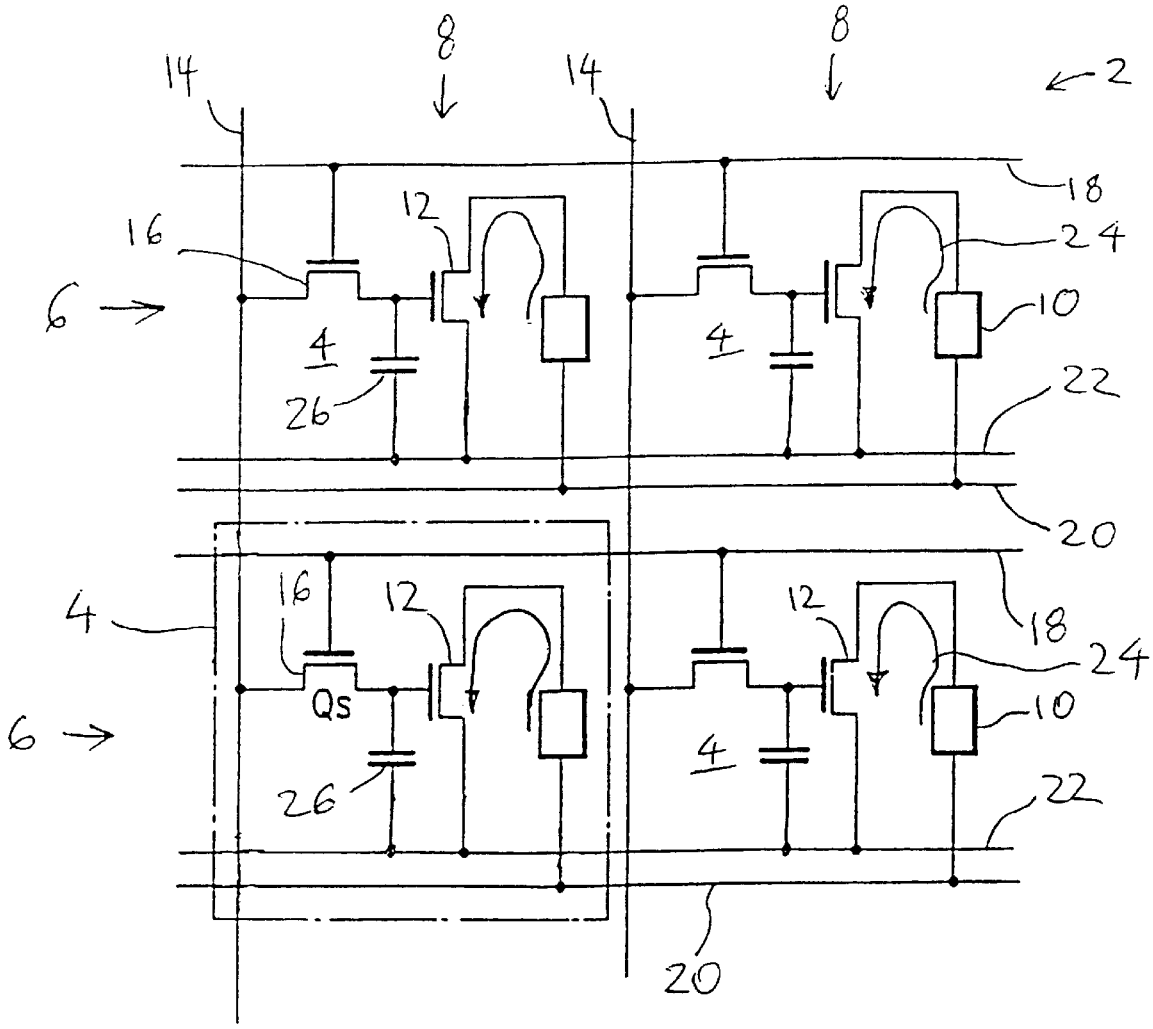
FIG. 1 shows part of an electroluminescent active matrix display device to which the invention may be applied.

FIG. 1 shows a known pixel configuration for an electroluminescent active matrix display device. Various types of electroluminescent display devices are known, which utilise current-controlled electroluminescent or light emitting diode display elements. An example of the construction of such a display is described in detail in U.S. Pat. No. 5,670,792.

As shown schematically in FIG. 1, a display device 2 comprises an array of pixels 4 arranged in rows 6 and columns 8. Each pixel 4 comprises a display element 10 and a switching element 12 in a form of a thin film transistor, which controls the operation of the display element 10 based on a signal voltage applied to the pixel 4. As one example, the display element 10 comprises an organic light emitting diode comprising a pair of electrodes between which one or more active layers of organic electroluminescent material is sandwiched. At least one of the electrodes is formed of a transparent material such as ITO. Various electroluminescent materials are available, for example as described in EP-A-0717446.

The signal voltage for a pixel is supplied via a control signal line 14 which is shared between a respective column 8 of pixels. The control signal line 14 is coupled to the gate of the switching transistor 12 through an address transistor 16. The gates for the address transistors 16 of a row 6 of pixels are coupled together to a common address line 18.

Each row 6 of pixels 4 also shares a common voltage supply line 20 usually provided as a continuous common electrode covering all pixels, and a common signal line 22. The display element 10 and the switching element 12 are arranged in series between the voltage supply line 20 and the common signal line 22, which acts as a current drain for the current flowing through the display element 10, as represented by arrows 24. The current flowing through the display element 10 is controlled by the switching element 12 and is a function of the gate voltage on the transistor 12, which is dependent upon the control signals supplied to the control signal line 14.

A row of pixels is selected by applying a selection pulse to the address line 18 which switches on the address transistors 16 for the respective row of pixels. A voltage level derived from the video information is applied to the control signal line 14 and is transferred by the address transistor 16 to the gate of the switching transistor 12. During the periods when a row of pixels is not being addressed by the address line 18, the address transistor 16 is turned off, but the voltage on the gate of the switching transistor 12 is maintained by a pixel storage capacitor 26 which is connected between the gate of the switching transistor 12 and the common signal line 22. The voltage between the gate of the switching transistor 12 and the common signal line 22 determines the current passing through the display element 10 of the pixel 4.

Thus, the current flowing through the display element is a function of the gate-source voltage of the switching transistor 12 (the source of the transistor 12 being connected to the common signal line 22, and the drain of the transistor 12 being connected to the display element 10). This current in turn controls the light output of the pixel.

The switching transistor 12 is arranged to operate. in saturation, so that the gate-source voltage governs the current flowing through the transistor, irrespectively of the drain-source voltage. Consequently, slight variations of the drain voltage do not affect the current flowing through the display element 10. The voltage on the voltage supply line 20 is therefore not critical to the correct operation of the pixels. However, voltage fluctuations on the common signal line 22, which couples together the sources of the switching transistors 12, will influence the current flowing through the display element 10 for a given control voltage on the control signal line 14.

A problem therefore arises that the resistance of the common signal line 22 gives rise to voltage drops along that line, which voltage drops are a function of the currents supplied to the line from the individual pixels 10. The voltages on the common signal line 22 at the location of different pixels will depend in a complex manner on the currents passed by all of the pixels in the row. The gate-source voltage of the switching transistor 12 will depend upon the voltage on the common signal line 22 at the location of that pixel, so that these voltage variations will affect the brightness of the pixels. The result is non-uniformity and horizontal cross-talk of the picture information shown on the display.

This invention provides an electroluminescent display device in which the control signals are modified to correct the signals applied to the display elements. The modification of the control signal is to ensure that an appropriate gate-source voltage is applied to the switching transistor 12 to give rise to the desired display element output. The voltages occurring at different points within the pixels, for example the gate and source voltages of the TFTs, are not accessible to the column driver circuitry, which generates the control signals for the control signal lines 14.

Figure 2:
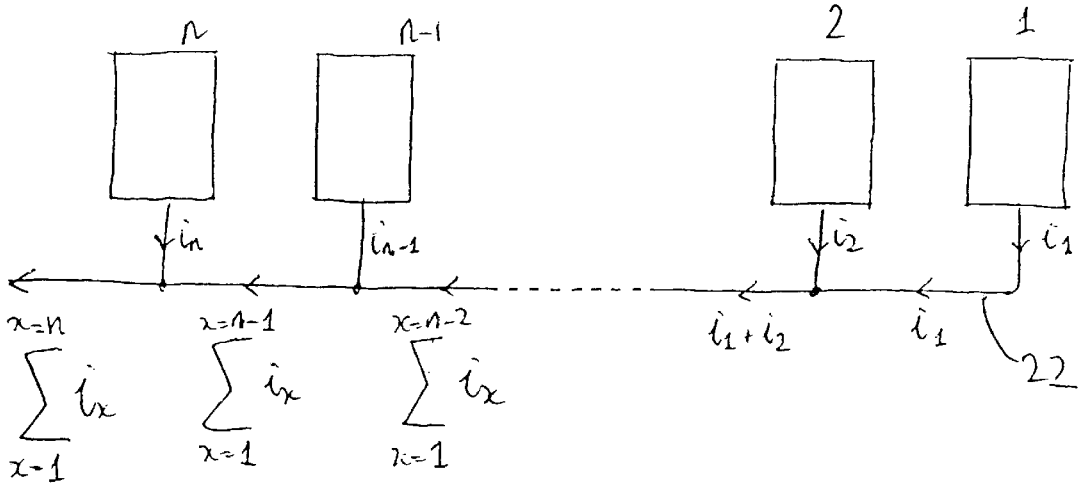
FIG. 2 schematically illustrates the current flowing in a row of electroluminescent display pixels, to illustrate the cross-talk resulting from the common signal line.

FIG. 2 shows the common signal line 22 with the currents $i_1, i_2, \ldots i_n$ associated with the pixels shown, there being n pixels in total in the row. These currents are the currents flowing through the pixels. A current summation occurs at each pixel location, as shown, and the voltage drop along each section of the common line 22 between adjacent pixels is a function of the current flowing in that section.

The currents i flowing through the pixels 10 are a function of the signal voltage applied to the control signal line. Thus:

$$i_k = f(V_k)$$

where $V_k$ is the voltage signal applied to the control signal line 14 for that pixel. The voltage drop between pixels 1 and 2 is therefore:

$$V_{1,2} = R.f(V_1)$$

where R is the line resistance for a section of the common signal line 22 corresponding to the pixel pitch. The value R may or may not be a constant, depending upon the signal line design. This notation shall be used in the following.

Assuming R is constant, the voltage drop between pixels 2 and 3 is:

$$V_{2,3} = R.(f(V_1) + f(V_2))$$

In general:

$$V_{k,k+1} = R \cdot \sum_{x=1}^{x=k} f(V_x)$$

Therefore, if the values of the control signals can be read, and the characteristics of the switching devices and of the display elements in the pixels can be modelled, then the voltage drops along the common signal line, and thereby the voltage at different points along the line, can be determined. The applied voltage at one end of the common line will be known.

For the purpose of a simplified analysis, we assume the lead out for the row is on the left, as shown in FIG. 2, and that the common signal line is at the correct voltage (for example 0V) at the location of the nth pixel, because the lead-out resistance can be ignored. In this case, the voltage across the nth display element is correct. The voltage difference on the common signal line at the location of the (n−1)th pixel is:

$$V_{n-1,n} = R \cdot \sum_{x=1}^{x=n-1} f(V_x)$$

This represents the error on the common line at pixel n−1, and thereby the amount by which the voltage across the display element is in error. For pixel n−2, the voltage drops $V_{n-1,n}$ and $V_{n-2,n-1}$ must be added.

Thus, in general, the voltage difference between the lead out voltage and the voltage on the common line at a pixel k is given by:

$$V_{error}(k) = \sum_{x=k}^{x=n-1} V_{x,x+1}$$

for all values of K from 1 to n−1, and with $V_{error}$ (n)=0.

The error value for each pixel can be calculated and can be used to compensate for the voltage drops along the common line. In the case of the pixel configuration of FIG. 1, this error value represents the amount by which the source voltage of the switching transistor 12 is too high. To compensate for this, the gate voltage needs to be increased by the same amount, in order to return to the correct gate-source voltage, which dictates the current flowing through the display elements, and thereby the brightness.

The voltage applied to the control signal line can then be modified by:

$$V'_k = V_k + V_{error}(k)$$

Figure 3:
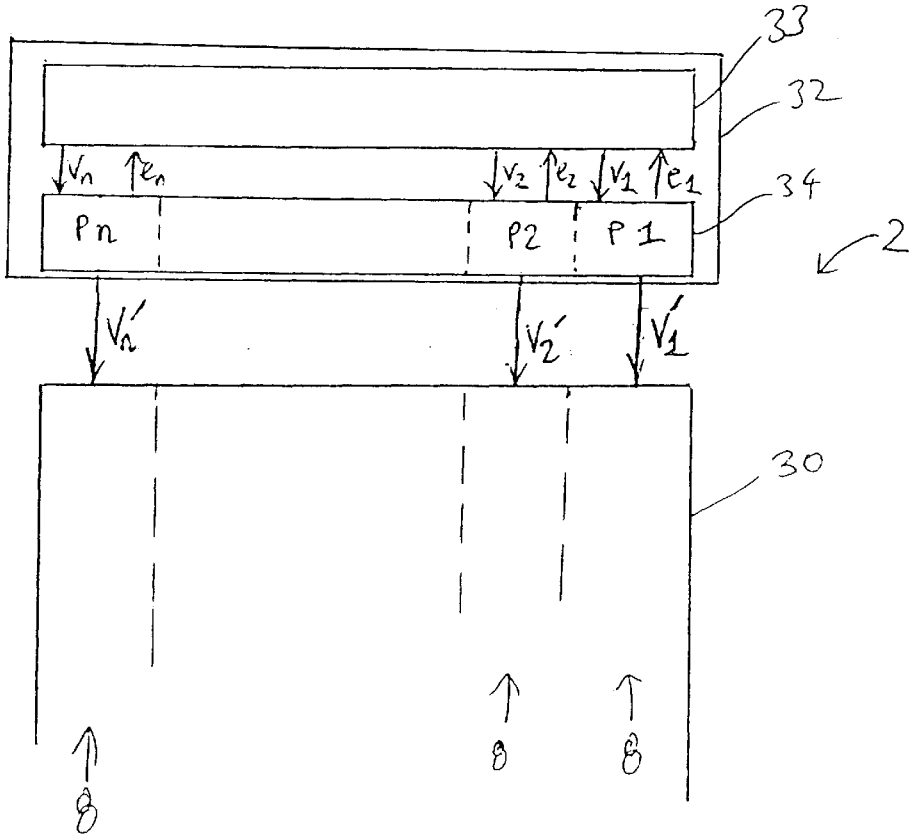
FIG. 3 shows a display device according to the invention.

FIG. 3 shows a display device according to the invention. The device 2 comprises a display area 30 which comprises pixels, for example as shown in FIG. 1. Driver circuitry 32 is provided which includes a conventional column driver unit 33 for generating signal voltages $V_1$, $V_2$ . . . $V_n$ corresponding to desired outputs from the display elements. These signal values are determined from a video input signal to the display device which originates from separate circuitry and which arranges the data into a standard format. In accordance with the invention, the driver circuitry 32 includes an additional circuit 34 to which the signals $V_1$, $V_2$ . . . $V_n$ are applied. Error values shown as $e_1$, e2, . . . $e_n$ (corresponding to $V_{error}$) are generated within the circuit 34 to enable updated signal voltages $V'_1$, $V'_2$ . . . $V'_n$ to be supplied to the pixels in the display area 30. The additional circuit 34 may comprise a line store for the values V and a computation unit for generating the error values from them.

The error values are obtained from modelling of a row of pixels to account for the different voltages on the common signal line. As described above, this modelling may take account of the characteristics of the switching transistor and/or of the display element as well as of the common line 22.

The error values enable the updated signal voltages V' to take account of the different voltages on the common signal line 22 at each pixel, which voltages will depend upon the signal voltages for the full row of pixels. In this way, the updated signal voltages V' enable cross-talk between the pixels in a display area to be eliminated.

In the analysis above, it is assumed that the lead-out resistance is negligible. In practice, there will of course be a voltage drop at the lead-out of the common line and which will be proportional to the total current flowing, and can therefore also be modelled. Furthermore, numerical errors in the modelling may be corrected by measuring the voltage drops across a line during a calibration of the modelling device.

Although a specific pixel configuration has been shown, various other pixel configurations will be apparent to those skilled in the art, and devices using those pixel configurations will benefit from the present invention, provided each row of pixels shares a common line, and in which the voltages at different points along this line may influence the output of the display elements.

What is claimed is:

1. An active matrix electroluminescent display device comprising:

an array of display pixels arranged in rows and columns, each pixel comprising an electroluminescent display element and a switching means for controlling the current through the display element based on a signal voltage applied to the pixel, each row of pixels sharing a common line, currents through the display elements of a row of pixels passing along the common lined giving rise to different voltages along the common signal line; and driver circuitry for generating signal voltages corresponding to desired outputs from the display elements, and for applying signal voltages to rows of pixels in sequence, characterised in that the device further comprises:

means for generating error values for each pixel in a row of pixels to be addressed derived from modelling of a row of pixels, the modelling taking account of the signal voltages to be applied to the pixels in the row, and the error values being used to account for the different voltages on the common line;

means for updating the signal voltages for each pixel in the row of pixels to be addressed, where required, using the error values; and means for supplying the updated signal voltages to the pixels.

2. A device as claimed in claim 1, wherein the display element and the switching means are arranged in series between a voltage supply line for the display elements and the common line, which acts as a current drain.

3. A display as claimed in claim 2, wherein an address line is associated with each row of pixels, and each pixel comprises an addressing switch which is controlled by the address line for switching the updated signal voltages to the switching means.

4. A display as claimed in claim 1 each pixel further comprises a charge storage element for holding a control voltage derived from the updated signal voltage on the switching means.

5. A display as claimed in claim 1 wherein the modelling includes modelling of the resistance per unit length of the common line and of the currents flowing along the common line as a result of the signal voltages applied to the display elements.

6. A method of driving an active matrix electroluminescent display device comprising an array of electroluminescent display pixels arranged in rows and columns, each row of pixels sharing a common line, currents through the display elements of a row passing along the common line, different voltages thereby being present at different points along the common line, the method comprising addressing rows of pixels in sequence, and for each row of pixels generating voltage signals for the pixels in the row, the generated voltage signals corresponding to desired pixel outputs, characterised in that the method further comprises:

generating error values derived from modelling of a row of pixels to account for the different voltages on the common line, the modelling taking account of the signal voltages to be applied to the pixels in the row;

updating the signal voltages for each pixel in the row, where required, using the error values; and supplying the updated signal voltages to the pixels.

* * * * *